US006556656B2

(12) United States Patent
Hess et al.

(10) Patent No.: US 6,556,656 B2
(45) Date of Patent: Apr. 29, 2003

(54) X-RAY TUBE PROVIDED WITH A FLAT CATHODE

(75) Inventors: Robert Hess, Hasloh (DE); Frank Demuth, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/861,934

(22) Filed: May 21, 2001

(65) Prior Publication Data

US 2002/0009179 A1 Jan. 24, 2002

(30) Foreign Application Priority Data

May 24, 2000 (DE) ..... 100 25 807

(51) Int. Cl.[7] ..... H01J 35/06
(52) U.S. Cl. ..... 378/136
(58) Field of Search ..... 378/121, 136, 378/137, 138, 101, 104, 119

(56) References Cited

U.S. PATENT DOCUMENTS 4,344,011 A 8/1982 Hayashi et al. ..... 378/138
4,868,842 A * 9/1989 Dowd ..... 378/138
5,007,074 A * 4/1991 Furbee et al. ..... 378/138
5,060,254 A * 10/1991 de Fraguier et al. ..... 378/136
5,123,038 A * 6/1992 Negle et al. ..... 378/101
5,563,923 A * 10/1996 Okada et al. ..... 378/138
5,633,907 A 5/1997 Gravelle et al. ..... 378/121
5,812,632 A * 9/1998 Schardt et al. ..... 378/137
5,910,974 A * 6/1999 Kuhn et al. ..... 378/138
6,229,876 B1 * 5/2001 Enck et al. ..... 378/136

* cited by examiner

*Primary Examiner*—Drew A. Dunn
*Assistant Examiner*—Allen C Ho
(74) *Attorney, Agent, or Firm*—John Vodopia

(57) ABSTRACT

The invention relates to an X-ray tube whose cathode arrangement includes a flat electron emitter that is provided with openings. An electrode is arranged on the side of the electron emitter that is remote from the anode of the X-ray tube; this electrode carries a negative potential relative to the electron emitter, which negative potential straightens the electron paths in front of the emitter. These steps result in a favorable ratio of the dimensions of the electron emitter to the dimensions of the focal spot formed on the anode by the emitted electrons.

8 Claims, 2 Drawing Sheets

X-RAY TUBE PROVIDED WITH A FLAT CATHODE

BACKGROUND OF THE INVENTION

Figure 1:
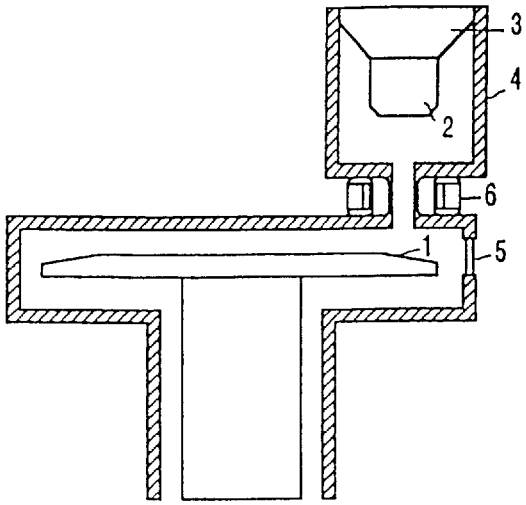

The invention relates to an X-ray tube which includes an anode and a cathode arrangement that includes a cathode cup for electron focusing, a flat electron emitter that is provided with openings, and an electrode that is arranged on the side of the electron emitter that is remote from the anode. An X-ray tube of this kind is known from U.S. Pat. No. 4,344,011. The electron emitter in one of the embodiments disclosed therein consists of a plane, flat and meandering metal band. Openings are thus present between the segments to and fro of said metal band.

The potential of the cathode cup in the known X-ray tube is variable relative to the electron emitter, so that faults in the manufacturing process do not have an effect on the dimensions of the focal spot. When the potential on the cathode cup is more positive than that on the electron emitter by a given amount, electrons from the lateral regions or from the back of the electron emitter can reach the cathode cup and heat the latter. Therefore, in one embodiment an electrode is arranged at a small distance from the electron emitter; this electrode shields the back and the lateral regions of the electron emitter and its potential corresponds at least approximately to the potential of the electron emitter.

The advantage of such a flat electron emitter over an electron emitter consisting of a helically wound wire is that the electron trajectories can be focused better, so that a focal spot having a more attractive electron density distribution is formed on the anode. However, the electron density distribution that can be achieved in the focal spot does not reach that of an ideal flat emitter. An ideal flat emitter is to be understood to mean a plane emitter having a thickness zero and no openings.

SUMMARY OF THE INVENTION

It is an object of the present invention to provide an X-ray tube of the kind set forth such that the characteristic of the ideal flat emitter is obtained at least approximately.

This object is achieved in accordance with the invention in that the electrode is arranged to be connected to a negative potential relative to the electron emitter in the operating condition of the X-ray tube, which negative potential is so high that the electric field strength in the space between the electrode and the electron emitter amounts to at least 20%, but preferably at least 100%, of the field strength on the side of the electron emitter that faces the anode.

The invention is based on the recognition of the fact that the electric field in the known X-ray tube, extends as far as into the openings, so that the equipotential lines on the surface of the electron emitter that faces the anode are drawn into the openings. Therefore, at the area of the openings there are formed electron trajectories that deviate from those of an ideal flat emitter and make it impossible to achieve the characteristic of such an ideal flat emitter. Because the electrode on the back side of the electron emitter that is remote from the anode carries a negative potential, the equipotential lines are pushed out of the openings again. A suitable choice of the potential enables the equipotential surfaces on the front side of the electron emitter that faces the anode to be substantially plane. The electron trajectories then extend rectilinearly and perpendicularly to the surface of the electron emitter throughout the vicinity thereof.

The above steps increase the ratio of the surface area of the electron emitter to the surface area of the focal spot. A given focal spot size can thus be obtained by means of a larger electron emitter. For achieving a given electron density in the focal spot the electron emitter can be kept at a lower temperature, so that its service life is prolonged. A further advantage offered by the invention is that it is now easier to control the position and/or size of the focal spot.

Preferred embodiments of the invention are set forth in the claims, wherein it is readily apparent that the electron emitter may also have a shape other than that of a meander (for example, the shape of a spiral), but a meander is easier to produce. In another embodiment, the electrode that is situated on the rear of the electron emitter has a better grip on the front of the electron emitter. The electric voltage between the electron emitter and the electrode can thus be reduced for the same distance between these elements.

In another embodiment, a different shape is also possible in principle, for example, a curved shape of the electron emitter. In that case the electrode should be adapted to said curvature.

When the electron emitter occupies a specific position as claimed, the electron emitter and the cathode cup can carry the same potential.

Another embodiment is claimed as an X-ray device which includes an X-ray tube as claimed. Another embodiment disclosed ensures that the bias voltage of the electrode is varied in dependence on the tube voltage (that is, the voltage between the anode and the cathode) in such a manner that the optimum field configuration is always achieved at the area of the electron emitter.

Figure 2:
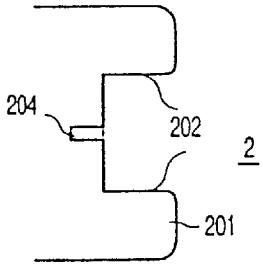
Figure 3:
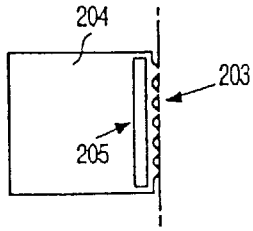
Figure 4:
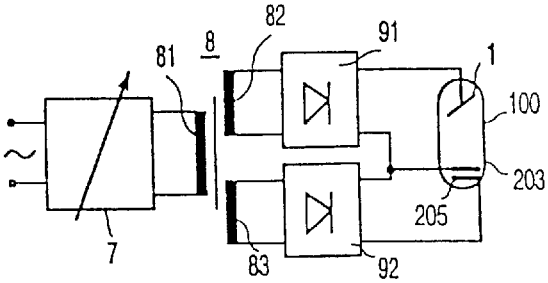

The invention will be described in detail hereinafter with reference to the drawings. Therein:

FIG. 1 is a diagrammatic representation of an X-ray tube in which the invention can be carried out, FIG. 2 shows the cathode arrangement of such a tube, FIG. 3 shows a part of said arrangement at an enlarged scale, FIG. 4 shows a block diagram of an X-ray device with an X-ray tube in accordance with the invention, and FIGS. 5*a* to *d* show the electron trajectories of different electron emitters.

DETAILED DESCRIPTION

The rotary anode X-ray tube shown in FIG. 1 includes an anode disc 1 that rotates in the operating condition and also includes a cathode arrangement 2. The cathode arrangement 2 is connected to the metal housing 4 of the X-ray tube via an isolator 3. The anode 1 may also be connected to the housing 4, via an isolator, or it may carry the potential of the (grounded) housing. The electrons emitted by the cathode are incident in a focal spot on the anode in which they generate X-rays that can emanate from the X-ray tube via a window 5. A quadrupole unit (6) is also shown in FIG. 1.

The X-ray tube shown in FIG. 1 is a rotary anode X-ray tube as used for medical diagnostic examinations. However, the invention can also be used for X-ray tubes with stationary anodes or for X-ray tubes that are not used in the medical field.

FIG. 2 is a cross-sectional view of the cathode arrangement. This Figure shows a cathode cup 201 which includes a cavity 202 that serves to focus the electron beam. At the center of the bottom of the cavity there is provided a slit 204 whose longitudinal direction extends radially to the axis of rotation of the anode disc 1.

BRIEF DESCRIPTION OF THE DRAWING FIGURES

As is clearly shown in FIG. 3, showing said slit at an increased scale, a flat, plane electron emitter 203 whose front side (being the side facing the anode 1) is situated in one plane with the bottom of the cavity is arranged in the slit. The electron emitter is shaped as a meander whose individual segments extend perpendicularly to the plane of drawing of FIG. 3 and hence in the longitudinal direction of the slit 204. The openings between neighboring segments have a dimension of approximately 0.1 mm whereas the width of the segments (being the dimension in the perpendicular direction in the plane of drawing) amounts to approximately 0.2 mm. However, the segments 2 may also extend perpendicularly to the longitudinal direction of the segment 204, like in the cited U.S. Pat. No. 4,344,011. Their manufacture is then easier. The electron emitter 203 is heated by an electric current that flows therethrough in the operating condition, so that it can emit electrons.

The field generated between the anode and the cathode in the operating condition extends into the cavity 202 and the openings between the segments. In the absence of compensation the equipotential surfaces would thus be drawn into the openings between the segments of the electron emitter 203, thus having the negative consequences described in the preamble. In order to avoid such consequences, an electrode 205 which carries a negative potential relative to the electron emitter 203 is arranged in the slit and on the rear of the electron emitter 203.

The construction of the X-ray generator feeding the X-ray tube 100 may also be different. It is essential only that it includes an (additional) direct voltage source for generating a direct voltage between the electron emitter 203 and the electrode 205, which direct voltage preferably varies in proportion to the high voltage between the anode and the cathode. (This condition is satisfied by the circuit that is shown in strongly simplified form in FIG. 4 and includes a transformer 8 which is connected to an inverter by way of its primary winding 81 controlled by variable gain controller 7, its secondary windings 82 and 83 being connected to the rectifiers 91, 92).

The negative bias voltage of the electrode 205 relative to the electron emitter 203 is chosen to be such that an approximately plane course is obtained for the equipotential surfaces on the front side of the electron emitter, that is, also at the area of the openings between the segments.

The construction of the X-ray generator feeding the X-ray tube 100 may also be different. It is essential only that it includes an (additional) direct voltage source for generating a direct voltage between the electron emitter 203 and the electrode 205, which direct voltage preferably varies in proportion to the high voltage between the anode and the cathode. (This condition is satisfied by the circuit that is shown in strongly simplified form in FIG. 4 and includes a transformer 8 which is connected to an inverter by way of its primary winding 81, its secondary windings 82 and 83 being connected to the rectifiers 91, 92).

Because the electron emitter obstructs the through-grip of the electric field existing between this emitter and the electrode, the electric field on the rear of the electron emitter must be stronger than that on the front. The amount of this excess is dependent on the thickness of the segments (being the dimensions in the horizontal direction in the plane of drawing of FIG. 4), on their width and on their spacing from one another. One possibility for improving the through-grip of the electric field that is generated on the front side of the electron emitter by the electrode 205 consists in beveling the side faces of the individual segments of the electron emitter in such a manner that they are tapered towards the electrode 203 or that the openings become wider in the direction of the electrode.

When the electric field strength behind the electron emitter is exactly equal to the electric field strength in front of the electron emitter, complete compensation of the field distortions caused by the openings in the electron emitter is not possible, but there still is a positive effect. In the case of a value of less than 20% of the field strength on the front side, the negatively biased electrode 205 practically has no effect.

The FIGS. 5*a* to *d* illustrate the effect of the invention in comparison with other embodiments of an electrode arrangement. The rendition of these Figures is distorted in a sense that the scale for the vertical dimensions is a number of times larger than the scale for the horizontal dimensions.

Figure 5A:
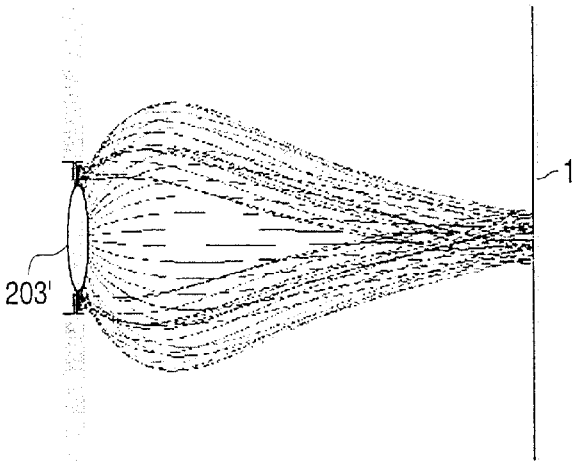
Figure 5B:
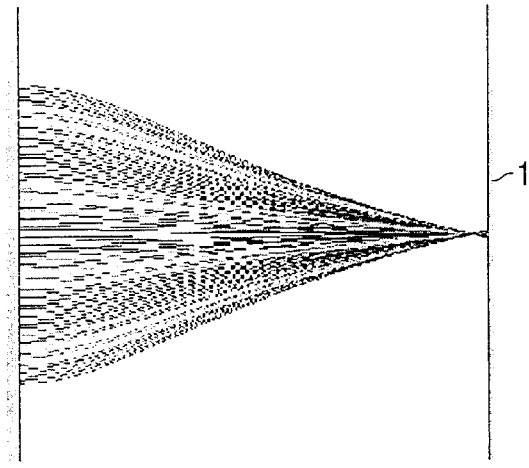

FIG. 5*a* shows the electron trajectory in the case of a helically wound wire 203' constituting the electron emitter (whose cross-section appears to be elliptical because of the distorted rendition). The course of the electron trajectories is dependent on the location on the electron emitter where the electrons emanate. Despite focusing (not shown), therefore, the electrons are incident in a comparatively large cross-section. FIG. 5*b* shows the conditions in the case of an ideal flat emitter. All electron trajectories start perpendicularly to the surface of the emitter until they are incident in a focal spot of minimum dimensions under the influence of a focusing field.

Figure 5C:
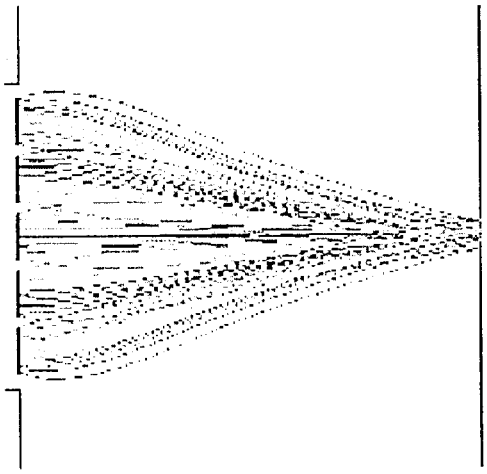

FIG. 5*c* shows the conditions in the case of a real meander-shaped electron emitter. The electron trajectories are curved in the edge regions of the segments of the electron emitter, leading to an enlargement of the focal spot (in comparison with the ideal flat emitter), despite the focusing. However, the focal spot is significantly smaller than in the case of a helically wound electron emitter.

Figure 5D:
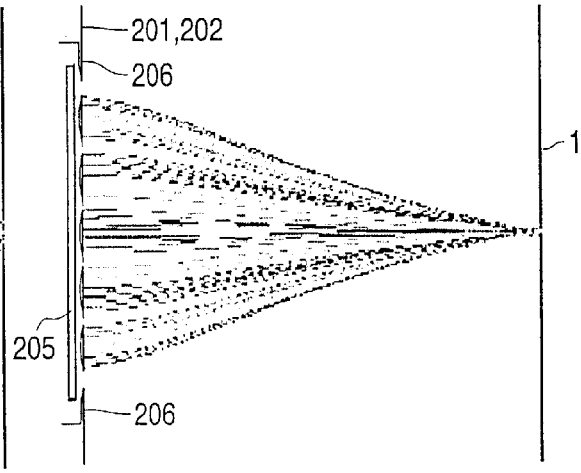

FIG. 5*d* shows the conditions for the cathode arrangement in accordance with the invention with a negatively biased electrode on the rear of the meander-shaped electron emitter. The electrons are first accelerated along trajectories extending perpendicularly to the electron emitter, after which they are focused in the focal spot. The circumstances are not quite as favorable as in FIG. 5*b*, but significantly better than in the case of the flat, meander-shaped emitter without the electrode (FIG. 5*c*). The slit is provided with projections 206 which shield the edges of the electrode whose dimensions are larger than those of the electron emitter.

What is claimed is:

1. An X-ray tube which includes an anode and a cathode arrangement that includes a cathode cup for electron focusing, a flat electron emitter that is provided with openings, and an electrode that is arranged on the side of the electron emitter that is remote from the anode, wherein the electrode is connected to a negative potential relative to the electron emitter in the operating condition of the X-ray tube, which negative potential is so high that the electric field strength in the space between the electrode and the electron emitter amounts to at least 20% of the field strength on the side of the electron emitter that faces the anode.

2. An X-ray tube as claimed in claim 1, wherein the electron emitter has a meandering shape.

3. An X-ray tube as claimed in claim 1, wherein the openings have a cross-section that becomes wider in the direction of the electrode.

4. An X-ray tube as claimed in claim 1, wherein the electrode and the electron emitter are plane.

5. An X-ray tube as claimed in claim 4, wherein the electron emitter is situated in a slit in the cathode cup whose upper surface is flush with the surface of the electron emitter that faces the anode, and that the cathode cup and the electron emitter carry at least approximately the same potential.

6. An X-ray tube as claimed in claim 1, wherein it includes a quadrupole unit for controlling the size and/or the position of the focal spot formed on the anode.

7. An X-ray device which includes an X-ray generator and an X-ray tube as claimed in claim 1, wherein the X-ray generator includes a voltage source for generating a potential on the electrode that is negative relative to the electron emitter.

8. An X-ray device as claimed in claim 7, including a high-voltage generator for generating a voltage between the anode and the cathode in the operating condition of the X-ray tube, wherein the voltage source is coupled to the high-voltage generator in such a manner that a fixed ratio that is independent of the voltage between the anode and the cathode exists between the voltages delivered by the high-voltage generator and the voltage source.

* * * * *